US009873011B2

(12) United States Patent
Lee

(10) Patent No.: US 9,873,011 B2
(45) Date of Patent: Jan. 23, 2018

(54) HYDRAULIC BENCH HEALTH MACHINE

(71) Applicant: Hal-In-Jum-Na-Ra, Chungcheongnam-do (KR)

(72) Inventor: Cha-young Lee, Chungcheongnam-do (KR)

(73) Assignee: Hal-In-Jum-Na-Ra, Yesan-Gun, Chungcheongnam-Do (KR)

( * ) Notice: Subject to any disclaimer, the term of this patent is extended or adjusted under 35 U.S.C. 154(b) by 0 days.

(21) Appl. No.: 15/464,299

(22) Filed: Mar. 20, 2017

(65) Prior Publication Data

US 2017/0189732 A1 Jul. 6, 2017

Related U.S. Application Data

(63) Continuation of application No. PCT/KR2015/002601, filed on Mar. 18, 2015.

(30) Foreign Application Priority Data

Nov. 21, 2014 (KR) ..... 10-2014-0163593

(51) Int. Cl.
*A63B 21/008* (2006.01)
*A63B 21/02* (2006.01)
(Continued)

(52) U.S. Cl.
CPC ..... *A63B 21/008* (2013.01); *A63B 21/023* (2013.01); *A63B 21/0428* (2013.01);
(Continued)

(58) Field of Classification Search
CPC ..... A63B 23/035; A63B 23/03575; A63B 21/008; A63B 21/0083; A63B 21/0085;
(Continued)

(56) References Cited

U.S. PATENT DOCUMENTS 4,183,520 A 1/1980 Chase
4,275,882 A * 6/1981 Grosser ..... A63B 21/00072 482/112
(Continued)

FOREIGN PATENT DOCUMENTS

JP 2006-000238 A 1/2006
KR 20-0250469 Y1 10/2001

OTHER PUBLICATIONS

International Search Report dated Jun. 22, 2015 for PCT/KR2015/002601, citing the above reference(s).

*Primary Examiner* — Nyca T Nguyen
(74) *Attorney, Agent, or Firm* — Hauptman Ham, LLP

(57) ABSTRACT

This disclosure relates to a health machine including: a main body constructed with a bench frame, leg frame and hammer frame; a bench installed on the bench frame; a leg extension weight training part and an arm curl weight training part installed on the leg frame; a hammer bench weight training part installed on the hammer frame; an intensity adjustment rod connected to the bench frame; an intensity adjustment band movably fixed to the intensity adjustment rod; a hydraulic cylinder connected to the bench frame and to the intensity adjustment band; a leg bar connected to the intensity adjustment rod and to the leg extension weight training part; an elastic member fixed to the bench frame and to the leg extension weight training part; an intensity adjustment band movably fixed to the intensity adjustment rod; and a hydraulic cylinder connected to the hammer frame and to the intensity adjustment band.

8 Claims, 10 Drawing Sheets

Figure 1:
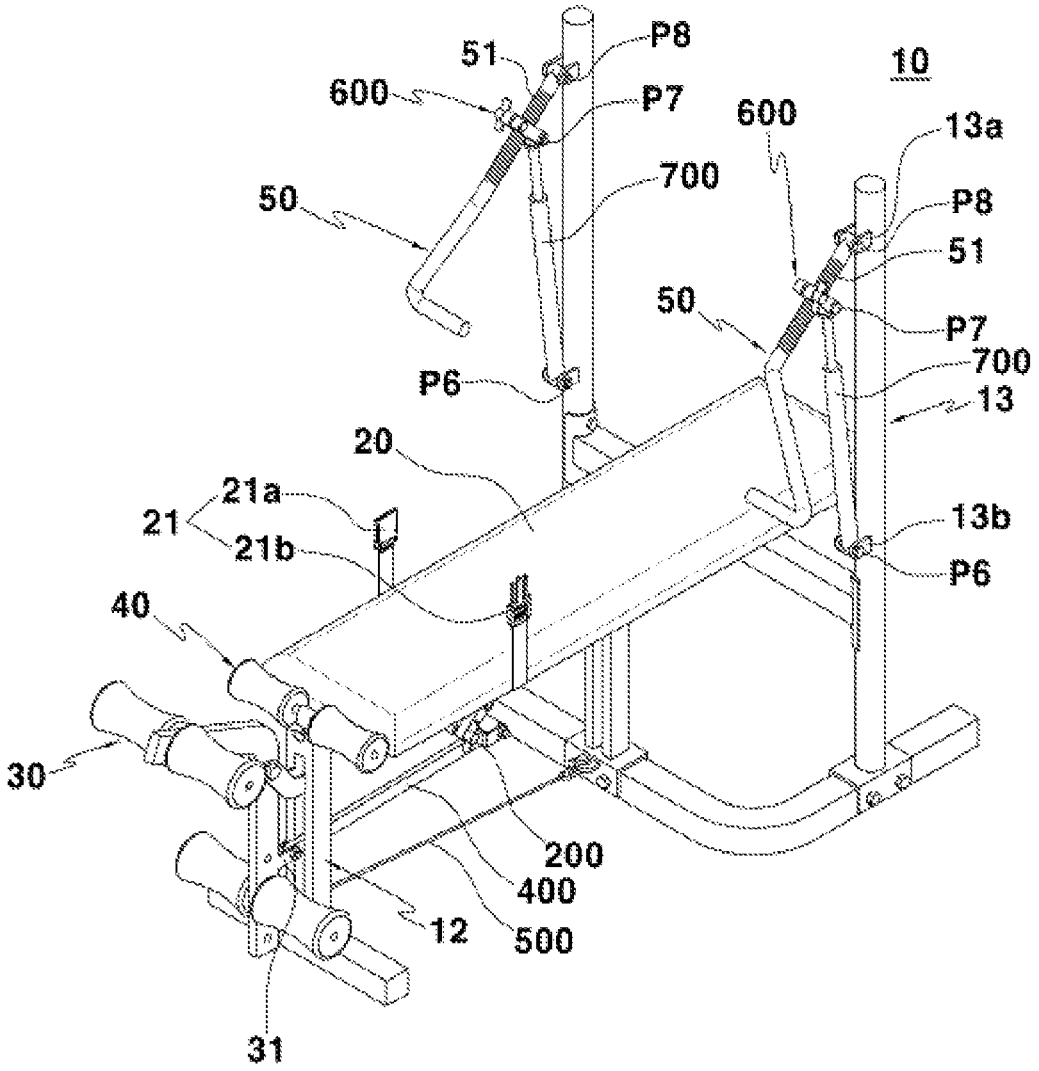

(51) Int. Cl.

| | |
|---|---|
| ***A63B 26/00*** | (2006.01) |
| ***A63B 21/06*** | (2006.01) |
| ***A63B 21/078*** | (2006.01) |
| ***A63B 21/04*** | (2006.01) |
| ***A63B 21/055*** | (2006.01) |

(52) U.S. Cl.
CPC ..... *A63B 21/0552* (2013.01); *A63B 21/06* (2013.01); *A63B 21/0615* (2013.01); *A63B 21/078* (2013.01)

(58) Field of Classification Search
CPC ..... A63B 21/0087; A63B 23/03508; A63B 23/03533; A63B 23/03541; A63B 21/4029; A63B 21/078
See application file for complete search history.

(56) References Cited

U.S. PATENT DOCUMENTS 4,407,495 A * 10/1983 Wilson ..... A63B 21/0615 482/138
4,645,205 A * 2/1987 Wolff ..... A63B 23/00 482/113
4,667,955 A * 5/1987 Giesch ..... A63B 21/0083 482/113
4,815,746 A * 3/1989 Ward, Jr. ..... A63B 21/078 482/104
4,848,739 A * 7/1989 Schaub ..... A63B 21/00072 482/113
4,883,269 A * 11/1989 Shaver ..... A63B 21/0615 482/138
4,911,436 A * 3/1990 Lighter ..... A63B 21/0087 482/113
4,915,379 A * 4/1990 Sapp ..... A63B 21/0083 482/113
5,058,888 A * 10/1991 Walker ..... A63B 23/00 482/112
5,064,193 A * 11/1991 Sainte ..... A63B 21/0083 482/113
5,928,116 A * 7/1999 Chiang ..... A63B 23/1209 482/133
2007/0219072 A1* 9/2007 Kessler ..... A63B 21/0083 482/112

* cited by examiner

HYDRAULIC BENCH HEALTH MACHINE

CROSS-REFERENCE TO RELATED APPLICATIONS

The present application is a continuation of International Patent Application No. PCT/KR2015/002601, filed on Mar. 18, 2015, which is based upon and claims the benefit of priority to Korea Patent Application No. 10-2014-0163593, filed on Nov. 21, 2014. The disclosures of the above-listed applications are hereby incorporated by reference herein in their entirety.

TECHNICAL FIELD

This invention involves a health machine designed to reinforce and develop various parts of a physical body. To be specific, this invention involves a health machine designed to simply and diversely adjust the weight load through using the leverage principle of the hydraulic cylinder without having to set different weights depending on the exercise intensity.

BACKGROUND TECHNOLOGY FOR INVENTION

In general, it is very important to exercise regularly to enhance muscular strength and endurance. However, it is not easy for the modern people to exercise due to their busy daily routines, and, therefore, the problem is that such modern people lack a healthy amount of exercise.

Along with the well-being trend that has been booming rapidly, the westernization of eating habits has been making contributions to the gradually lowering age groups suffering from adult diseases. Accordingly, our society's overall demand for various leisure activities and indoor/outdoor exercises has been expanding.

To cope with our society's overall demand, various sports facilities are rapidly being installed not at many places not only around large cities, but also around small and medium-sized cities. In particular, health centers where exercise can be carried out without being influenced by the weather or season are becoming more and more popular.

Such health centers are used as a complex health space where not only various aerobic exercises, but also various muscular exercises for diverse parts of a physical body can be carried out. In particular, the reason that such health centers are popular among people willing to carry out muscular exercises is that the load of the muscular exercises can be adequately adjusted (load increase/decrease) depending on their physical conditions or amount of exercise.

On the other hand, nothing compares to weight training when it comes to an exercise for activating blood circulation and cardiopulmonary function and enhancing bone density. Accordingly, there is a popular demand for an all-in-one health machine that can be used by all members of the family to train each and every part of their physical bodies.

To cope with such demand, the Registered Utility Model No. 20-0250469, which is a patent document, specifies a weight training machine that can be used to apply and carry out diverse weight training exercises.

However, since the preexisting health machines are designed so that the weights piled up at one place deliver weight to various health machines, structurally, the volume of such health machines is excessively large and heavy, and there is a risk of injury during weight adjustments.

In addition, the weight of the preexisting health machines ranges from 150 kg to 250 kg due to their piled up weights, and, therefore, it is difficult to transport such preexisting health machines.

In addition, it is difficult for the users to adjust the weight of the preexisting health machines to their preference, and the exercise effects that can be gained from such preexisting health machines are limited.

PRIOR ART DOCUMENT

Patent Document

Patent Document: Registered Utility Model No. 20-0250469(2001.10.04)

INVENTION DETAILS

Problem to be Solved

The purpose of this invention is to settle the preexisting flaws described above. Namely, the purpose of this invention is to provide a health machine designed to simply and diversely adjust the weight load through using the leverage principle of the hydraulic cylinder without having to set different weights depending on the exercise intensity.

Another purpose of this invention is to provide a health machine designed to completely remove the risk of negligent accidents which may be caused due to the piled up weights.

Another purpose of this invention is to provide a health machine designed to decrease the overall machine volume/weight, so that it can be conveniently moved and transported.

Another purpose of this invention is to provide a health machine designed to allow its users to easily adjust the weight resistance to their preference for exercise purposes.

Another purpose of this invention is to provide a health machine designed to maximize ease of use and exercise efficiency.

Plan for Problem Solving

To accomplish the above purpose, in this invention, the main body is constructed with the bench press, leg frame and hammer frame, the bench is installed on the upper part of the above bench frame, the leg extension weight training part and arm curl weight training part are installed on the above leg frame respectively, the hammer bench weight training part is installed on the above hammer frame, one end of the intensity adjustment rod is connected to the lower front part of the above bench frame as the axis pin, the intensity adjustment band is movably fixed to the above intensity adjustment rod, the both ends of the hydraulic cylinder are connected to the lower back section of the above bench frame and to the intensity adjustment band respectively as the axis pins, the both ends of the leg bar are connected to the other end of the above intensity adjustment rod and to the leg extension weight training part respectively as the axes, the both ends of the elastic member are fixed to the above bench frame and to the lower part of the leg extension weight training part respectively, the intensity adjustment band is movably fixed to the intensity adjustment rod prepared on the back part of the above hammer bench weight training part, and the both ends of the hydraulic cylinder are connected to the front center section of the above hammer frame and to the intensity adjustment band respectively as the axis pins.

In addition, in this invention, a pair of brackets providing support is constructed on the above bench frame and on the above hammer frame respectively for the joint between the intensity adjustment rod and hydraulic cylinder to rotate as the axis pin, and the bearing is mounted on the pin hole of the above joint.

In addition, in this invention, a pair of connection pieces providing supports is installed on one side of the above intensity adjustment band for joint of the hydraulic cylinder to rotate as the axis pin, the insert hole where the intensity adjustment rod will be movably inserted is established on the center part of the above intensity adjustment band respectively, a pair of fixing piece with an established cutting part for penetration to the insert hole is established on the other side of the above intensity adjustment band respectively, a screw is used to combine the fixing knob with the above fixing piece respectively, the knurling for expanding the frictional force is established on the outer surface of the above intensity adjustment rod respectively, and the bearing is mounted on the pin hole of the above joint respectively.

In addition, in this invention, a pair of connection pieces providing support are connected to one side of the above intensity adjustment band respectively for the joint of the hydraulic cylinder to rotate as the axis pin, the insert hole where the intensity adjustment rod will be movably inserted is established on the center part of the above intensity adjustment band respectively, a number of pin holes are established on the above intensity adjustment rod respectively at appropriate intervals, the fixing pin to be inserted into the pin hole is installed on the above intensity adjustment band respectively, and the bearing is installed on the pin hole of the above joint respectively.

In addition, in this invention, a pair of support pieces providing support is installed on the back part of the above leg bar respectively for the joint of the other end of the intensity adjustment rod to rotate as the axis pin, a pair of brackets providing support are installed on the above leg extension weight training part respectively for the joint of the front end of the leg bar to rotate as the axis, and the bearing is mounted on the pin hole of the above joint respectively.

In addition, in this invention, the above elastic member is made of rubber band or spring. In addition, in this invention, the leg fixing band with mutually lockable/unlockable female/male buckles attached to it is installed on the above bench.

Invention Effects

The strength of this invention is that, different from the preexisting health machines that require the weight to be replaced according to the exercise intensity, the leverage principle of the hydraulic cylinder can be used through the intensity adjustment band to simply and diversely adjust the weight load.

In addition, the strength of this invention is that since the weight is not used, the risk of negligent accidents to be caused by the weight can be completely removed, and that the reduced volume and weight allow convenient transfer and transport overall.

In addition, the strength of this invention is that the users can easily adjust the weight resistance to their preference through moving the intensity adjustment band, and that the ease of use and exercise efficiency can be maximized through such process.

SIMPLE DRAWING DESCRIPTIONS

FIG. 1 displays a perspective view of the health machine specified in this invention.

Figure 2:
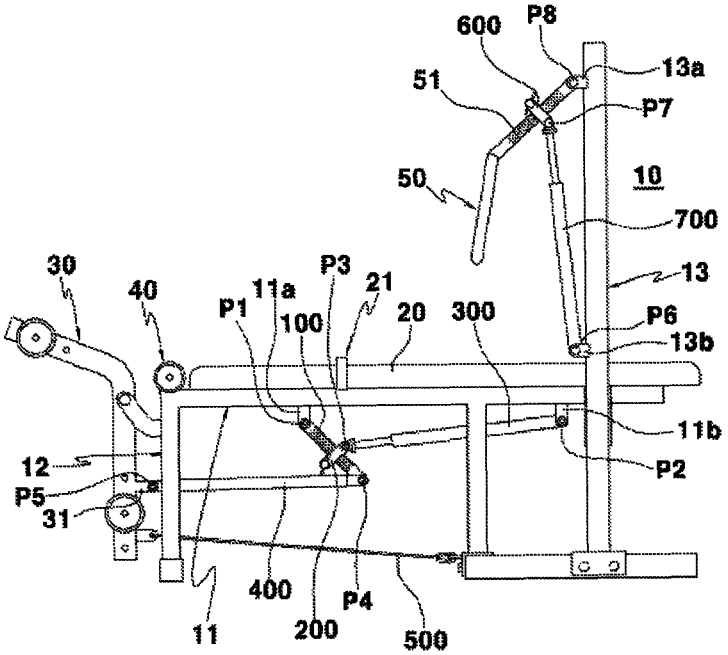

FIG. 2 displays a side view of the health machine specified in this invention.

Figure 3:
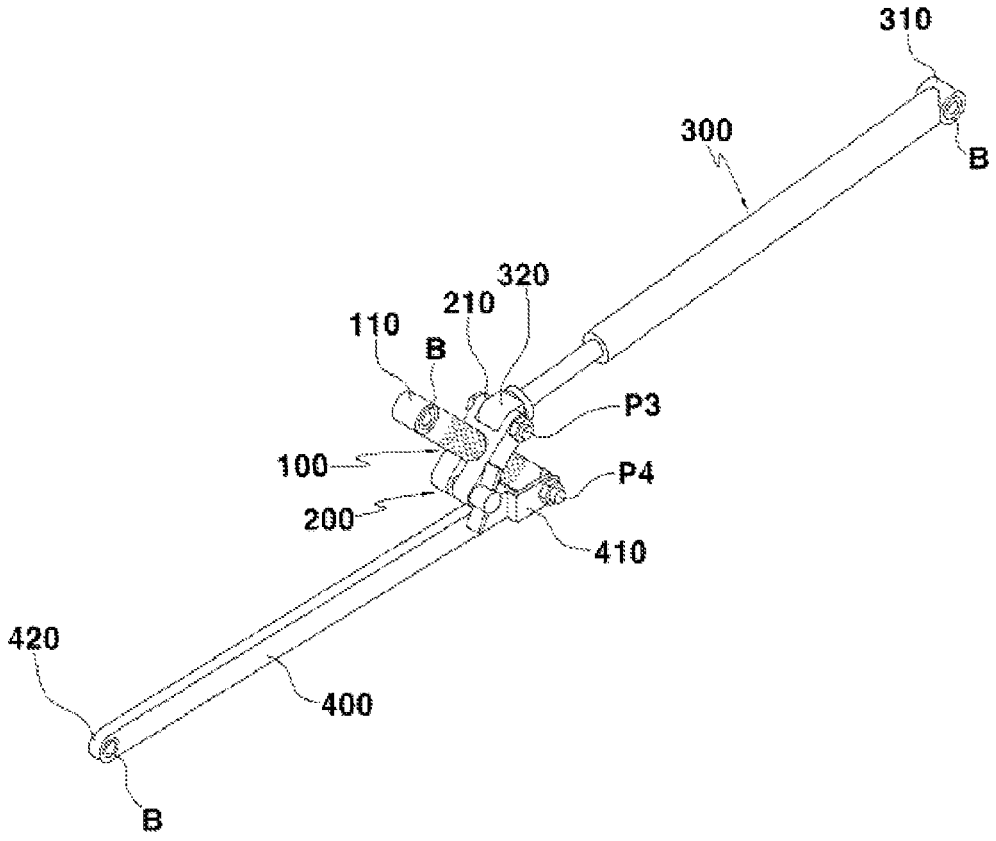

FIG. 3 displays a perspective view of an essential part of this invention.

Figure 4:
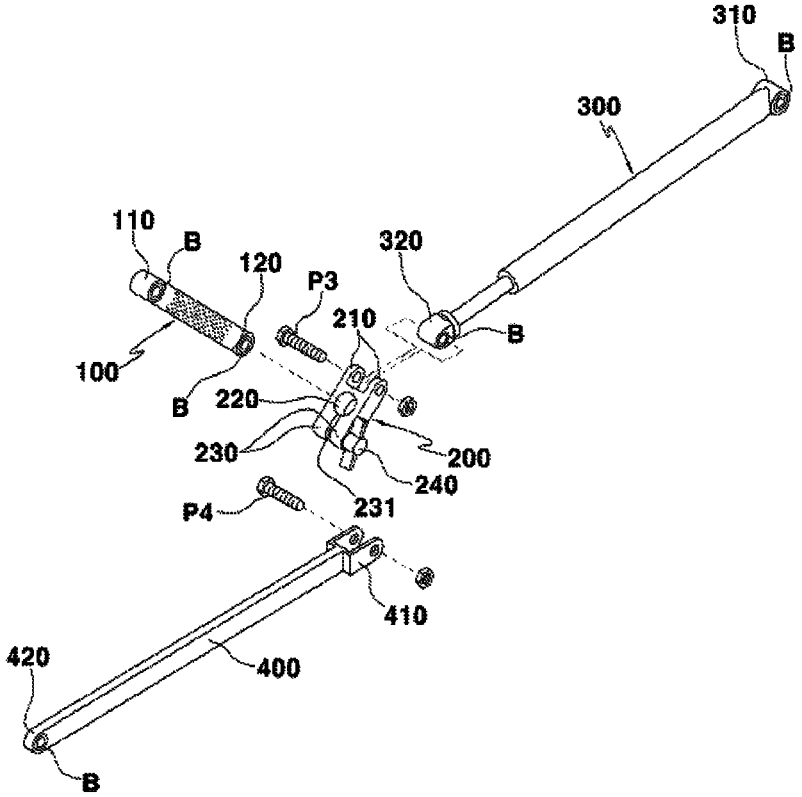

FIG. 4 displays an exploded perspective view of FIG. 3.

Figure 5:
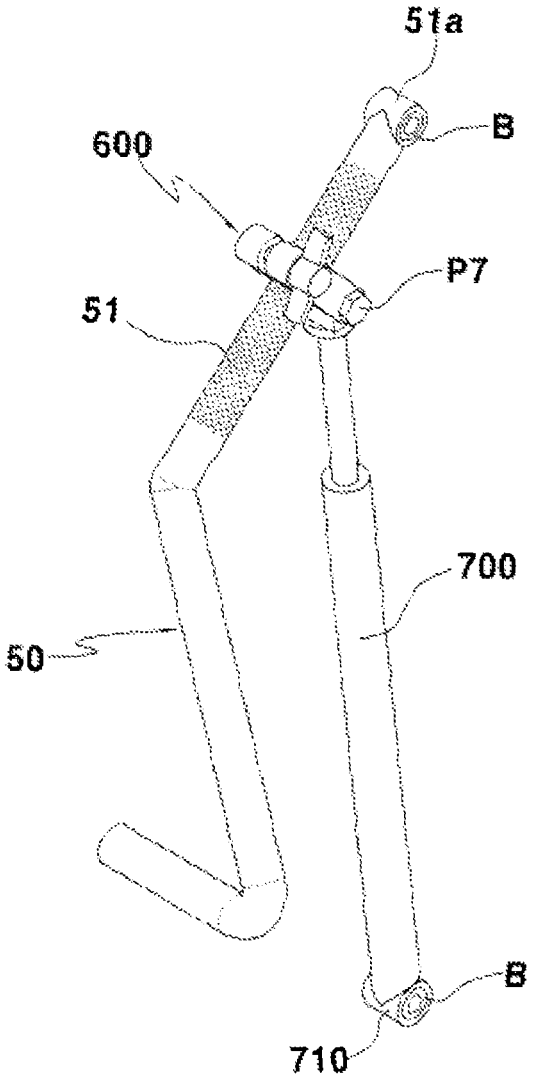

FIG. 5 displays a perspective view of another essential part of this invention.

Figure 6:
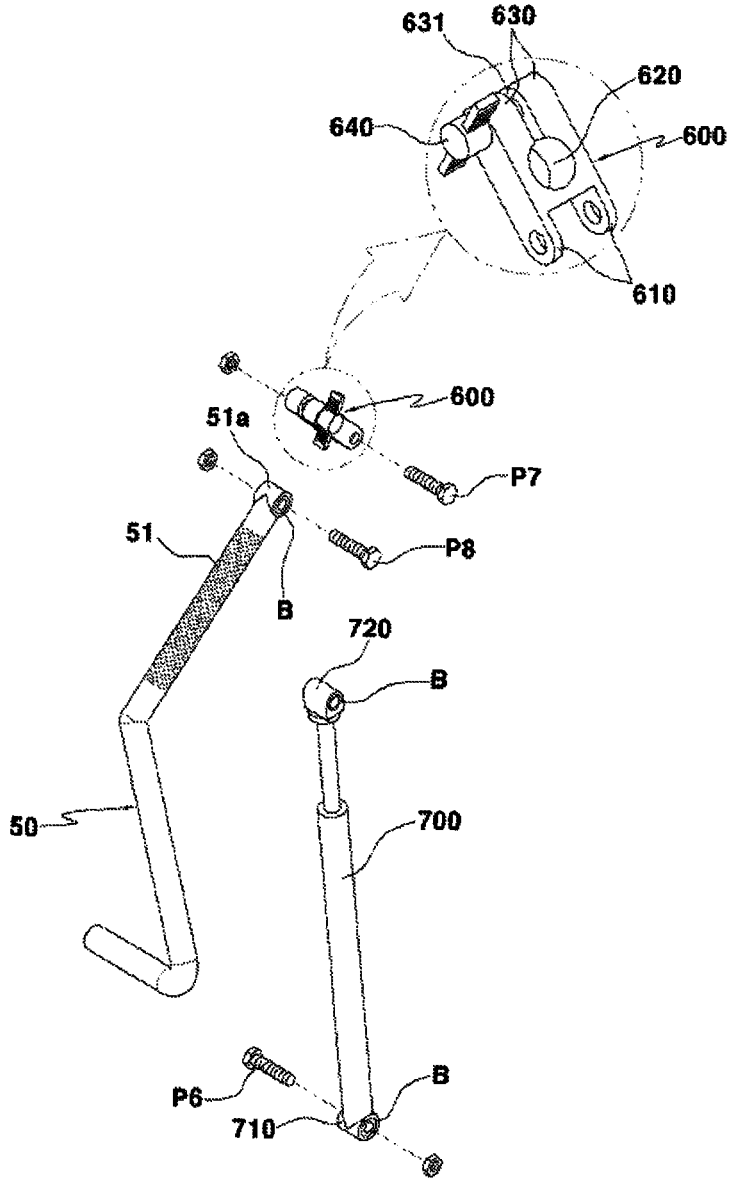

FIG. 6 displays an exploded perspective view of FIG. 6.

Figure 7A:
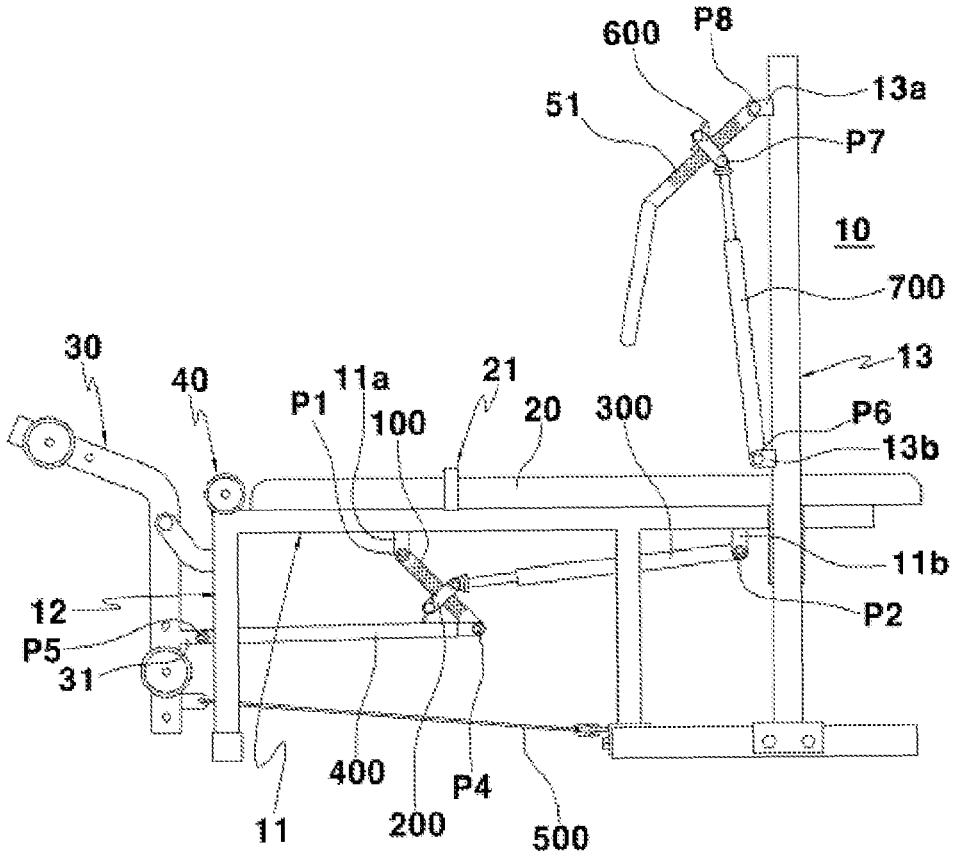
Figure 7B:
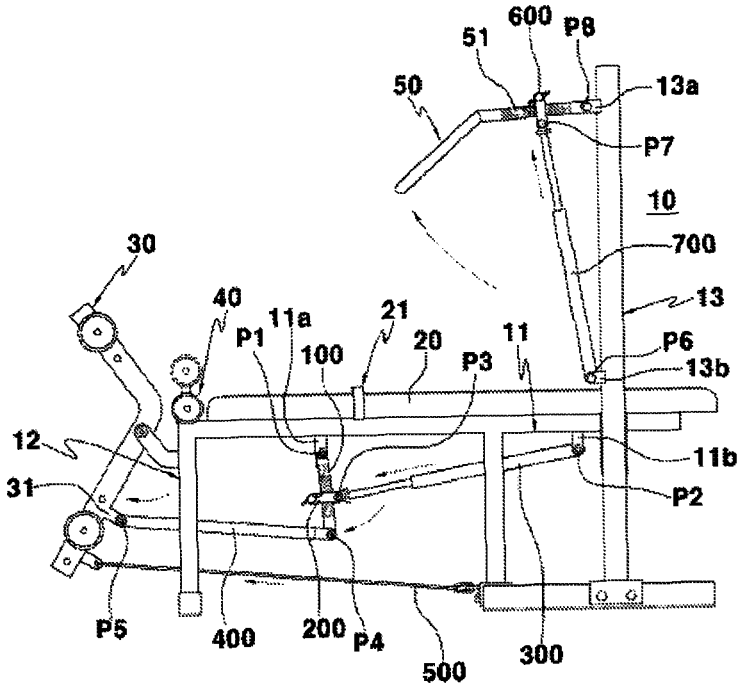

FIGS. 7*a* & 7*b* display the operating status of this invention.

Figure 8:
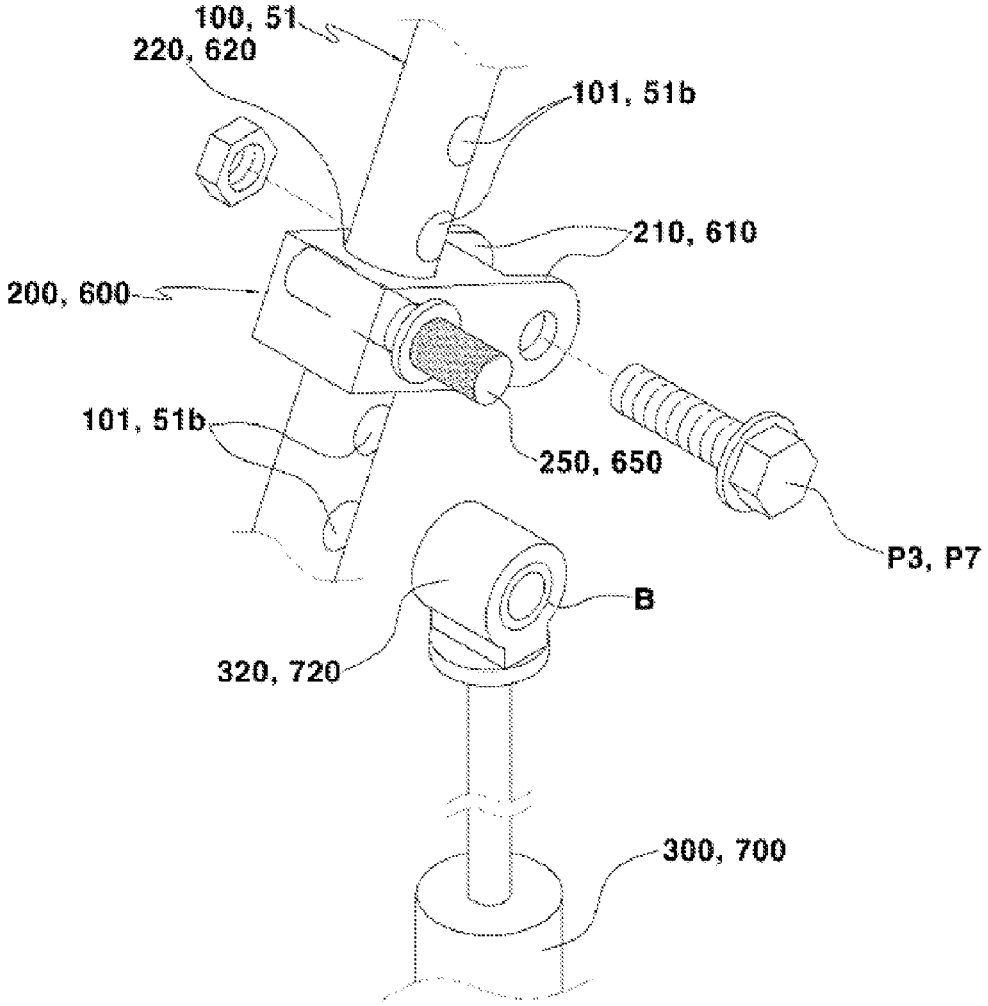

FIG. 8 displays a perspective view of other executed examples of the intensity adjustment rod and intensity adjustment band specified in this invention.

Figure 9:
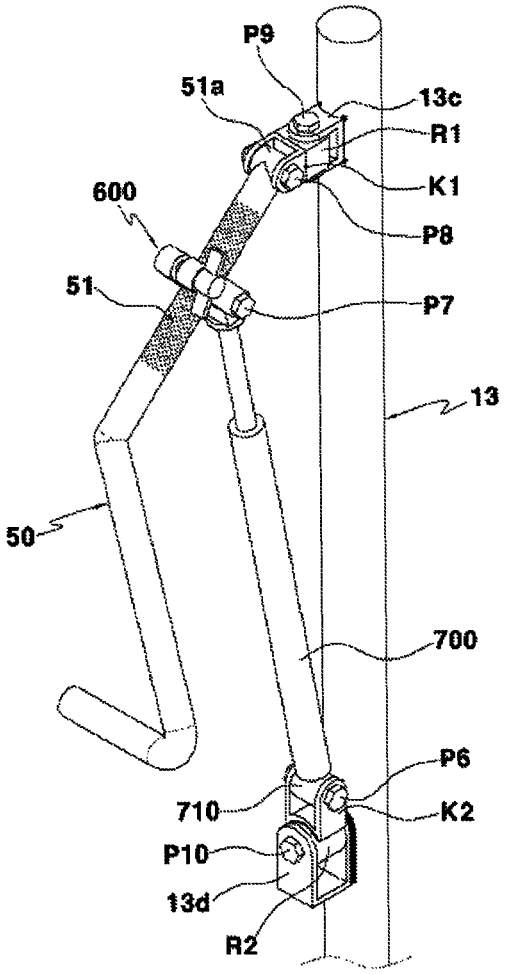

FIG. 9 displays a perspective view of other executed examples of this invention.

SPECIFIC DETAILS FOR CONDUCTING INVENTION

The technical configuration of this invention displayed on the attached drawings can be specifically described as follows.

As displayed on FIGS. 1-9, the basic technical configuration of the health machine specified in this invention is as follows: the main body (10) constructed with the bench frame (11), leg frame (12) and hammer frame (13); the bench (2) installed on the above bench frame (11); the leg extension weight training part (30) and arm curl training part (40) installed on the above leg frame (12); the hammer bench weight training part (50) installed on the above hammer frame (13); one part of the intensity adjustment rod (100) connected to the lower front part of the above bench frame (11) as the axis pin (P1); the intensity adjustment band (200) movably fixed to the above intensity adjustment rod (100); the both ends of the hydraulic cylinder (300) connected to the lower back part of the above bench frame (11) and to the intensity adjustment band (200) respectively as the axis pins (P2)(P3); the both ends of the leg bar (400) connected to the other end of the above intensity adjustment rod (100) and to the leg extension weight training part respectively as the axes (P4)(P5); the both ends of the elastic member (500) fixed to the upper bench frame (11) and to the lower part of the leg extension weight training part (30); the intensity adjustment band (600) movably fixed to the intensity adjustment rod (51) prepared on the back part of the above hammer bench weight training part (50); and the both ends of the hydraulic cylinder (700) connected to the front center part of the upper hammer frame (13) and to the intensity adjustment band (600).

At this point, the above main body (10) is the main body of the health machine specified in this invention, and such main body (1) is constructed with the bench frame (11), leg frame (12) and hammer frame (13). At this point, the bench (20) is installed on the bench frame (11) of the above main body (10).

The above bench (20) is installed on the upper part of the bench frame (11), and such bench (20) is a rectangle type that is used by the users to lie down on, sit on and stand on for weight training.

According to this invention, as shown in FIG. 1, the leg fixing band (21) with mutually lockable/unlockable female/male buckles (21*a*)(21*b*) attached to it is installed on the above bench (20). At this point, the above leg fixing band (21) is designed to be used for the high fly exercise.

The above leg extension weight training part (30) is installed on the leg frame (12), and such leg extension weight training part (30) is designed to be used for exercises involving lower body muscles such as leg muscles. At this point, the leg extension weight training part (30) is designed so that the users can sit on the bench (20) to conduct the leg extension exercise and lie face down to conduct the leg curl exercise.

The above arm curl weight training part (40) is vertically-movably installed on the leg frame (12), and such arm curl weight training part (40) is designed to be used for exercises involving arm muscles. At this point, the above arm curl weight training part (40) is designed so that the arm support can be lifted up for the arm curl exercise.

The above hammer bench weight training part (50) is vertically-movably installed on the both sides of the hammer frame (13) respectively, and such hammer bench weight training part (50) is designed to be used for exercises involving upper body muscles such as triceps and chest muscles. At this point, the above hammer bench weight training part (50) is designed so that the users can sit on or lie down on the bench (20) and use the vertical rotation of 180 degrees to conduct the arm curl health machine exercise, shoulder health machine exercise, chest press health machine exercise and hammer bench health machine exercise. On the other hand, the intensity adjustment rod (51) is prepared on the above hammer bench weight training part (50), the back end of the above intensity adjustment rod (51) is connected to the upper front part of the hammer frame (13) so that it rotates as the axis pin (P8), and the joint (51*a*) is established on the back end of the above intensity adjustment rod (51).

One end of the above intensity adjustment rod (100) is connected to the lower front part of the bench frame (11) so that it rotates as the axis pin (P1), and the other end of such intensity adjustment rod (100) is connected to the back end of the leg bar (400) so that it rotates as the axis pin (P4). At this point, the joints (110)(120) are established on the both ends of the above intensity adjustment rod (100) respectively.

The above intensity adjustment band (200) is movably fixed to the intensity adjustment rod (100), and such intensity adjustment band (200) applies the leverage action to the hydraulic cylinder (300) to play the role of adjusting the weight load. At this point, as the above intensity adjustment band (200) moves closer to the axis pin (P1) on one end of the intensity adjustment rod (200), the weight load of the hydraulic cylinder (300) decreases due to the leverage principle. On the other hand, as the above intensity adjustment band (200) moves closer to the axis pin (P4) on the other end of the intensity adjustment rod (200), the weight load of the hydraulic cylinder (300) increases due to the leverage principle.

The both ends of the above hydraulic cylinder (300) are connected to the lower back part of the bench frame (11) and to the intensity adjustment band (200) respectively so that they rotate as the axis pins (P2)(P3), and such hydraulic cylinder (300) plays the role of applying the weight load counteracting with the preexisting weight while the leg extension weight training part (30) is used for the weight training exercise. At this point, the hydraulic oil viscosity of the above hydraulic cylinder (300) is optimally adjusted to the 250 kg health machine so that the users can adjust the weight resistance to their preference for exercises involving weight resistances ranging up to 250 kg.

According to this invention, a pair of brackets (11*a*)(11*b*) providing support is installed on the above bench frame (11) respectively for the joint (110)(310) between the intensity adjustment rod (100) and hydraulic cylinder (300) to rotate as the axis pins (P1)(P2), and the bearing (B) is mounted on the pin hole of the above joints (110)(310) respectively.

According to one executed example of this invention, as displayed in FIGS. 3 & 4, a pair of connection pieces (210) providing support is installed on one side of the above intensity adjustment band (200) for the joint (320) of the hydraulic cylinder (300) to rotate as the axis pin (P3), the insert hole (220) where the intensity adjustment rod (100) will be movably inserted is established on the center part of the above intensity adjustment band (200), a pair of fixing pieces (230) with an established cutting part (231) for penetration to the insert hole (22) is established on the other side of the above intensity adjustment band (200), a screw is used to combine the fixing nob (240) with the above fixing piece (230), the knurling for expanding the friction force is established on the outer surface of the above intensity adjustment rod (100), and the bearing (B) is mounted on the pin hole of the above joint (320). At this point, when the above fixing knob (240) is loosened, the users can easily adjust the weight resistance to their preference in units of millimeter through moving the intensity adjustment band (200), and when the fixing knob (240) is fastened after the adjustment, the intensity adjustment band (200) becomes rigidly fixed to the intensity adjustment rod (100).

According to another executed example of this invention, a pair of connection pieces (210) providing support is installed on one side of the above intensity adjustment band (200) for the joint (320) of the hydraulic cylinder (300) to rotate as the axis pin (P3), the insert hole (220) where the intensity adjustment rod (100) will be movably inserted is established on the center part of the above intensity adjustment band (200), a number of fixing pins (250) to be inserted into the pin hole (101) are installed on the above intensity adjustment band (200), and the bearing (B) is mounted on the pin hole of the above joint (320). At this point, when the above fixing pin (250) is taken out and the intensity adjustment band (200) is moved, the users can easily adjust the weight resistance to their preference through choosing from a number of pin holes (101) established at intervals of 20 ml, and when the fixing pin (250) is inserted after the adjustment, the intensity adjustment band (200) becomes rigidly fixed to the intensity adjustment rod (100).

The both ends of the above leg bar (400) are connected to the other end of the intensity adjustment rod (100) and to the leg extension weight training part (30) respectively as the axes (P4)(P5), and since the leg extension weight training part (30) is connected to such leg bar (400), when the leg bar (400) is pulled forward while the leg extension weight training part (30) is used for the weight training exercise, as displayed in FIG. 7*b*, the axis (P4) on the other end of the intensity adjustment rod (100) rotates forward, and, therefore, the weight resistance counteracting with the preexisting weight applies to the hydraulic cylinder (300) and elastic member (500).

According to this invention, a pair of support pieces (410) providing support is installed on the back end of the above leg bar (400) for the joint (120) on the other end of the intensity adjustment rod (100) to rotate as the axis pin (P4), a pair of brackets (31) providing support is installed on the above leg extension weight training part (30) for the joint (420) on the front end of the leg bar (400) to rotate as the axis (P5), and the bearing (B) is mounted on the pin hole of the above joints (120)(420) respectively.

The both ends of the above elastic member (500) are fixed to the bench frame (11) and to the lower part of the leg extension weight training part (30) respectively, and such elastic member (500) plays the role of applying the weight resistance (tensile force) to the leg extension weight training part (30) while the leg extension weight training part (30) is used for the weight training exercise. At this point, the above elastic member (500) performs reciprocating motions during the weight training exercise.

According to this invention, the above elastic member (500) is made of rubber band or spring. At this point, the above rubber band is structured so that a number of thin rubber bands are covered in a thread, and the above spring is structured as a tension spring.

The above intensity adjustment band (600) is movably fixed to the intensity adjustment rod (51) prepared on the back part of the hammer bench weight training part (50), and such intensity adjustment band (600) plays the role of adjusting the weight load through applying the leverage action to the hydraulic cylinder (700). At this point, as the above intensity adjustment band (600) moves closer to the axis pin (P8) on the back end of the intensity adjustment rod (51), the weight load of the hydraulic cylinder (300) decreases due to the leverage principle. On the other hand, as the above intensity adjustment band (600) moves closer to the front part of the intensity adjustment rod (51), the weight load of the hydraulic cylinder (700) increases due to the leverage principle.

The both ends of the above hydraulic cylinder (700) are connected to the front center part of the hammer frame (13) and to the intensity adjustment band (600) so that they rotate as the axis pins (P6)(P7) respectively, and such hydraulic cylinder (700) plays the role of applying the weight load counteracting with the preexisting weight while the hammer bench weight training part (50) is used for the weight training exercise. At this point, the hydraulic oil viscosity of the above hydraulic cylinder (700) is optimally adjusted to the 250 kg health machine so that the users can adjust the weight resistance to their preference for exercises involving weight resistances ranging up to 250 kg.

According to this invention, a pair of brackets (13*a*)(13*b*) providing support is installed on the above hammer frame (13) respectively for the joint (51*a*)(710) between the intensity adjustment rod (51) and hydraulic cylinder (700) to rotate as the axis pins (P8)(P6), and the bearing (B) is mounted on the pin hole of the above joint (51*a*)(710) respectively.

According to one executed example of this invention, as shown in FIGS. 5 & 6, a pair of connection pieces (610) providing support is installed on one side of the above intensity adjustment band (600) for the joint (720) of the hydraulic cylinder (700) to rotate as the axis pin (P7), the insert hole (620) where the intensity adjustment rod (51) will be movably inserted is established on the center part of the above intensity adjustment band (600), a pair of fixing pieces (630) with an established cutting part (631) for penetration to the insert hole (620) is established on the other side of the above intensity adjustment band (600), a screw is used to combine the fixing knob (640) with the above fixing pieces (630), the knurling for expanding the friction force is established on the outer surface of the above intensity adjustment rod (51), and the bearing (B) is mounted on the pin hole of the above joint (720). At this point, when the above fixing knob (640) is loosened, the users can easily adjust the weight resistance to their preference in units of millimeter through moving the intensity adjustment band (600), and when the fixing knob (640) is fastened after the adjustment, the intensity adjustment band (600) becomes rigidly fixed to the intensity adjustment rod (51).

According to another executed example of this invention, as shown in FIG. 8, a pair of connection pieces (610) providing support is installed on one side of the above intensity adjustment band (600) for the joint (720) of the hydraulic cylinder (700) to rotate as the axis pin (P7), the insert hole (620) where the intensity adjustment rod (51) will be movably inserted is established on the center of the above intensity adjustment band (600), a number of pin holes (51*b*) are established on the above intensity adjustment rod (51) at appropriate intervals, the fixing pin (650) to be inserted into the pin hole (51*b*) is installed on the above intensity adjustment band (600), and the bearing (B) is mounted on the pin hole of the above joint (720). At this point, when the above fixing pin (650) is taken out and the intensity adjustment band (600) is moved, the users can easily adjust the weight resistance to their preference through choosing from a number of pin holes (51*b*) established at intervals of 20 ml, and when the fixing pin (650) is inserted after the adjustment, the intensity adjustment band (600) becomes rigidly fixed to the intensity adjustment rod (51).

On the other hand, according to the other executed example of this invention, as shown in FIG. 9, the brackets (13*c*)(13*d*) providing support are installed on the above hammer frame (13) respectively for the rotation rings (R1)(R2) to rotate as the axis pins (P9)(P10), and the rotation brackets (K1)(K2) providing support are connected to the above rotation rings (R1)(R2) respectively for the joint (51*a*)(710) between the intensity adjustment rod (51) and hydraulic cylinder (700) to rotate as the axis pins (P8)(P6). At this point, the above rotation rings (R1)(R2) and the rotation brackets (K1)(K2) must provide support so that the hammer bench weight training part (50) can vertically and horizontally rotate in 360 degrees.

This invention constructed as described allows the users to adjust the weigh resistance to their preference ranging from 3 kg to 250 kg through the hydraulic cylinder (300)(700) without using any weight, and the compact size allows the users to simply adjust the weight and lie down on the bench (20) or stand on the bench (20) to conduct all kinds of exercise allowed on the hammer bench health machine, high fly health machine, long pull health machine, leg extension health machine, leg curl health machine, arm curl health machine, shoulder press health machine and chest press health machine.

Namely, in this invention, for the intensity adjustment, the intensity adjustment rod (100)(51), intensity adjustment band (200)(600) and hydraulic cylinder (300)(700) are installed so that the all-in-one upper body exercise can be conducted on the bench (20) and that the all-in-one lower body exercise can be conducted on the bench (20) as well. The users can lie down on the bench (20) to conduct the hammer bench health machine exercise, inversely switch the pressure direction of the hydraulic cylinder (700) and sit on the bench (20 to conduct the high fly health machine exercise, stand on the bench (20) to conduct the long pull health machine exercise, sit on the bench (20) to conduct leg extension health machine exercise, lie face down to conduct the leg curl health machine exercise, lift the arm curl weight training part (40) to conduct the arm curl health machine exercise, sit on the bench (20) to conduct the shoulder press health machine exercise, and lie down on the bench (20) to conduct the chest press health machine exercise.

Accordingly, the strength of this invention is that, different from the preexisting health machines that require the weight to be replaced according to the exercise intensity, the users can use the leverage principle of the hydraulic cylinder (300)(700) and the reciprocating motion of the elastic member (500) through the intensity adjustment band (200)(600) to simply and diversely adjust the weight load.

In addition, the strength of this invention is that since the weight is not used, the risk of negligent accidents to be caused by the weight can be completely removed, and that the reduced volume and weight allow convenient transfer and transport overall.

In addition, the strength of this invention is that the users can easily adjust the weight resistance to their preference through moving the intensity adjustment band (200)(600), and that the ease of use and exercise efficiency can be maximized through such process.

[Mark Descriptions]

| | |
|---|---|
| 10: Main Body | 11: Bench Frame |
| 11a,11b: Bracket | 12: Leg Frame |
| 13: Hammer Frame | 13a, 13b: Bracket |
| 20: Bench | 21: Leg Fixing Band |
| 21a: Female Buckle | 21b: Male Buckle |
| 30: Leg Extension Weight Training Part | |
| 31: Bracket | |
| 40: Arm Curl Weight Training Part | |
| 50: Hammer Bench Weight Training Part | |
| 51: Intensity Adjustment Rod | 51a: Joint |
| 51b: Pin Hole | 100: Intensity Adjustment Rod |
| 101: Pin Hole | 110, 120: Joint |
| 200: Intensity Adjustment Band | 210: Connection Piece |
| 220: Insert Hole | 230: Fixing Piece |
| 231: Cutting Part | 240: Fixing Knob |
| 250: Fixing Pin | 300: Hydraulic Cylinder |
| 310, 320: Joint | 400: Leg Bar |
| 410: Support Piece | 420: Joint |
| 500: Elastic Member | 600: Intensity Adjustment Band |
| 610: Connection Piece | 620: Insert Hole |
| 630: Fixing Piece | 631: Cutting Part |
| 640: Fixing Knob | 650: Fixing Piece |
| 700: Hydraulic Cylinder | 710, 720: Joint |

What is claimed is:

1. A health machine comprising:

a main body comprising a bench frame, a leg frame extended from the bench frame and configured to support the bench frame, and a hammer frame connected to the bench frame and configured to support the bench frame with the leg frame;

a bench installed on the bench frame;

a leg extension weight training part and arm curl weight training part installed on the leg frame;

a hammer bench weight training part having a first intensity adjustment rod connected to an upper portion of the front side of the hammer frame;

a second intensity adjustment rod connected to a front portion of the bottom side of the bench frame;

a first intensity adjustment band coupled on the first intensity adjustment rod;

a second intensity adjustment band coupled on the second intensity adjustment rod;

a first hydraulic cylinder connected between a center portion of the front side of the hammer frame and the first intensity adjustment band;

a second hydraulic cylinder connected between a rear portion of the bottom side of the bench frame and the second intensity adjustment band;

a leg bar connected between the second intensity adjustment rod and the leg extension weight training part respectively; and an elastic member connected between the bench frame and a lower portion of the leg extension weight training part.

2. The health machine of claim 1, wherein the bench frame comprises a first bracket installed on the front portion of the bottom side of bench frame and connected to the second intensity adjustment rod to provide a first joint, and a second bracket installed on the rear portion of the bottom side of bench frame and connected to one end of the second hydraulic cylinder to provide a second joint, wherein the hammer frame comprises a third bracket installed on the upper portion of the front side of the hammer frame and connected to the first intensity adjustment rod to provide a third joint, and a fourth bracket installed on the center portion of the front side of the hammer frame and connected to one end of the first hydraulic cylinder to provide a fourth joint, and wherein each of the first, second, third and fourth joint comprises a pin hole, respectively, and a bearing is mounted on the pin hole of each joint.

3. The health machine of claim 1, wherein the first intensity adjustment band comprises a first pair of connection pieces formed on one end of the first intensity adjustment band and connected to the first hydraulic cylinder, a first insert hole formed on the center portion of the first intensity adjustment band, and coupled with the first intensity adjustment rod, a first pair of fixing pieces with a first established cutting part, formed on the other end of the first intensity adjustment band, and a first fixing knob combined the first pair of fixing pieces to fix the first intensity adjustment band to the first intensity adjustment rod, wherein the second intensity adjustment band comprises a second pair of connection pieces formed on one end of the second intensity adjustment band and connected to the second hydraulic cylinder, a second insert hole formed on the center portion of the second intensity adjustment band, and coupled with the first intensity adjustment rod, a second pair of fixing pieces with a second established cutting part, formed on the other end of the second intensity adjustment band, and a second fixing knob combined the second pair of fixing pieces to fix the second intensity adjustment band to the second intensity adjustment rod, and wherein each of the first and second intensity adjustment rod comprises knurling established on an outer surface of each of the first and second intensity adjustment rod.

4. The health machine of claim 1, wherein the first intensity adjustment band comprises a first pair of connection pieces formed on one end of the first intensity adjustment band and connected to the first hydraulic cylinder, and a first insert hole formed on the center portion of the first intensity adjustment band, and coupled with the first intensity adjustment rod, wherein the second intensity adjustment band comprises a second pair of connection pieces formed on one end of the second intensity adjustment band and connected to the second hydraulic cylinder, and a second insert hole formed on the center portion of the second intensity adjustment band, and coupled with the second intensity adjustment rod, wherein each of the first and second intensity adjustment rod comprises a plurality of pin holes established, at predetermined intervals, on an outer surface of each of the first and second intensity adjustment rod, and a fixing pin inserted into one of the plurality of pin holes to fix the first or second intensity adjustment band to corresponding first or second intensity adjustment rod, respectively, and wherein each of the first and second hydraulic cylinder comprises a joint hole formed on one end of each of the first and second hydraulic cylinder, and a bearing mounted on the joint hole and coupled with corresponding first or second pair of connection pieces to provide a joint between each of the first and second hydraulic cylinder and corresponding first or second intensity adjustment band.

5. The health machine of claim 1, wherein the leg extension weight training part comprises a bracket extended from the leg extension weight training part, wherein the leg bar comprises a pair of support pieces formed on one end of the leg bar and connected to the second intensity adjustment rod, a first joint hole formed on the other end of the leg bar and coupled with the bracket of the leg extension weight training part, and a first bearing mounted on the joint hole to provide a joint between the leg bar and the leg extension weight training part, and wherein the second intensity adjustment rod comprises a second joint hole formed on one end of the second intensity adjustment rod and coupled with the pair of support pieces of the leg bar, and a second bearing mounted on the second joint hole to provide a second joint between the leg bar and the second intensity adjustment rod.

6. The health machine of claim 1, wherein the elastic member is rubber band or spring.

7. The health machine of claim 1, wherein the bench comprises a leg fixing band having a buckle and installed on the bench.

8. The health machine of claim 1, wherein the hammer bench comprises a first bracket having a first rotation ring to provide a first joint between the hammer bench and the first intensity adjustment rod, the first bracket installed on the upper portion of the front side of the hammer frame and connected to the first intensity adjustment rod, and a second bracket having a second rotation ring to provide a second joint between the hammer bench and the first hydraulic cylinder, the second bracket installed on the center portion of the front side of the hammer frame and connected to the first hydraulic cylinder.

* * * * *